United States Patent [19]

Hara et al.

[11] Patent Number: 4,606,289

[45] Date of Patent: Aug. 19, 1986

[54] SEWING THREAD CUTTING DEVICE

[75] Inventors: Kazumasa Hara, Tokyo; Masashi Sato, Kanagawa; Mikio Koike; Kenji Kaneko, both of Tokyo, all of Japan

[73] Assignee: Janome Sewing Machine Co., Ltd., Tokyo, Japan

[21] Appl. No.: 445,032

[22] Filed: Nov. 29, 1982

[30] Foreign Application Priority Data

Dec. 7, 1981 [JP] Japan ..... 56-195654

[51] Int. Cl.[4] ..... D05B 65/00

[52] U.S. Cl. ..... 112/295; 112/299; 225/91; 242/48

[58] Field of Search ..... 112/285, 295, 298, 299; 242/19, 48; 225/88, 91

[56] References Cited

U.S. PATENT DOCUMENTS

| | | | |
|---|---|---|---|
| 11,624 | 6/1981 | Furniss | 112/295 X |
| 771,434 | 10/1904 | Matthews | 112/295 |
| 1,251,352 | 12/1917 | Voe | 112/295 |
| 2,343,091 | 1/1948 | Arrington | 242/19 |
| 2,372,609 | 3/1945 | Silverman | 112/295 X |
| 4,250,601 | 2/1981 | Ward | 225/91 |

FOREIGN PATENT DOCUMENTS

| | | | |
|---|---|---|---|
| 514672 | 12/1930 | Fed. Rep. of Germany | 225/91 |
| 531300 | 1/1922 | France | 225/91 |
| 1442179 | 5/1966 | France | 112/299 |
| 146474 | 2/1981 | German Democratic Rep. | 112/299 |
| 16188 | of 1892 | United Kingdom | 112/299 |

*Primary Examiner*—Werner H. Schroeder
*Assistant Examiner*—Andrew M. Falik
*Attorney, Agent, or Firm*—Michael J. Striker

[57] ABSTRACT

A thread-cutting device for a sewing machine comprises a cutter having a cutting edge and a thread guiding member which holds the cutter. The thread guiding member is formed with thread guiding edges which obliquely cross the cutting edge of the cutter, and leads the threads between its two parallel thread guiding edges and the cutting edge of the cutter. A crossing point between the thread guiding member and the cutting edge of the cutter is adjustable.

11 Claims, 11 Drawing Figures

SEWING THREAD CUTTING DEVICE

BACKGROUND OF THE INVENTION

The invention relates to a thread cutting device of a sewing machine, and more particularly to a device which could cut the thread with a slight thread tension.

Various kinds of the thread cutting devices of the sewing machines have been known. FIG. 1 of the drawings shows an example of the conventional thread cutting device 1 which is in use at the present time and which is formed with an oblique cutting edge 2*a* in a presser bar 2. The thread is cut with this device by pulling down the ends of the thread 3 by fingers 4. In the prior art cutting devices the presser bar 2 of the sewing machine has a notch or a groove 2*a* extended at a proper angle to the center axis of the presser bar to provide an edge extended along the outer contour of the notch 2*a*. As shown in FIG. 1, the sewer usually inserts thread 3 into notch 2*a* and then pulls the thread toward the sewer to press the thread against the edge of notch 2*a* to cut off the thread. However, in fact, the sewer often inserts thread 3 into the notch 2*a* until the thread comes to the bottom of the notch 2*a*, and then pulls the thread toward himself or herself to cut off the thread. Therefore only the bottom part of the edge of notch 2*a* is used to cut off the thread 3, and the bottom edge of the notch can easily become blunt and useless. Moreover, the thread yarns will accumulate in the notch 2*a* and deteriortate the function of the cutter. The thread cutting edge is therefore not effectively utilized.

SUMMARY OF THE INVENTION

The present invention has been devised to improve the existing thread cutting devices.

An object of the invention is to cut the thread with slight thread tension which is effected by resistance when the thead is drawn out from a thread supply.

Another object of the invention is to heighten safety of the thread cutter by shielding the cutting edge of the cutter with a cover.

A further object of the invention is to adjust a crossing point between a thread guiding face of a thread guiding member and the cutting edge of the cutter in order to always provide a desired thread cutting.

These and other objects of the invention are attained by a thread cutting device of a sewing machine, comprising a blade having a thread cutting edge; and a blade cover member including two plates spaced from each other to form a space to accomodate said blade, said cover member having an end side and being formed with a thread-guiding opening at said end side and with a recess, said opening merging into said recess, said recess defining on said plates two parallel guide for edges spaced from each other, said blade being positioned between said plates so that said cutting edge intersects said edges at a predetermined acute angle, whereby as the thread is moved through said opening and said recess toward the cutting edge of said blade so that said guide edges and said cutting edges impact tension to the thread received in said space while the thread is pressed against said guide edges.

BRIEF DESCRIPTION OF THE DRAWINGS

FIGS. 2 to 7 illustrate embodiments of the thread cutting device according to the present invention, of which FIG. 2 is a perspective view of a thread cutting means, and FIGS. 3 to 7 are perspective views illustrating the thread cutting means attached to the sewing machine at desired portions respectively;

FIGS. 8 and 9 show another embodiment according to the invention, in which FIG. 8 illustrates a perspective view of the thread cutting means and FIG. 9 illustrates a perspective view of a portion of the cutter shown in FIG. 8;

DETAILED DESCRIPTION OF THE PREFERRED EMBODIMENT

Figure 1:
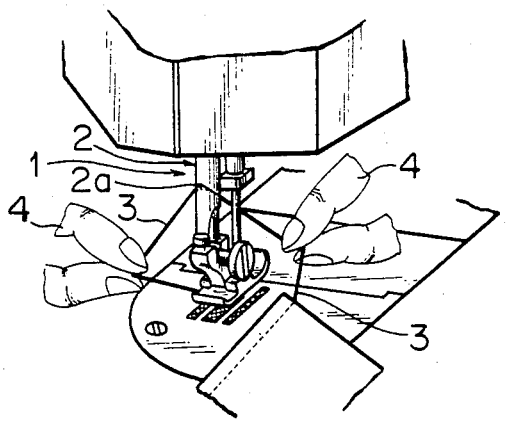
FIG 1 PRIOR ART
FIG. 1 is a perspective view of a thread cutting means on a sewing machine according to the prior art.
Figure 2:
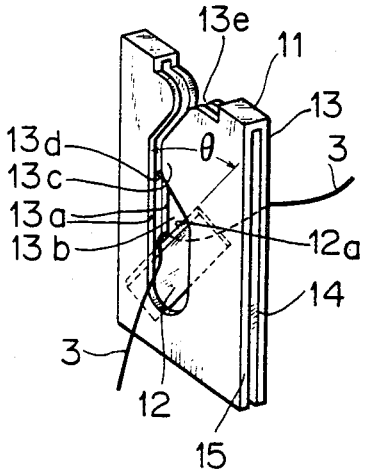

The present invention will be expalined in reference to the embodiments shown in the attached drawings. A thread cutting device 11 of the sewing machine in accordance with the invention comprises, as shown in FIG. 2, a cutter 12 and a thread guiding member 13. The cutter 12 is formed with a cutting edge 12*a*.

The thread guiding member 13 is U-shaped, and the cutter 12 is fixed by such means as welding between opposing walls 14 and 15 of member 13 such that the cutting edge 12*a* faces upwardly. The thread guiding member 13 is formed with a recess or opening 13*b*, a cover 13*c*, a groove 13*d* of narrow width, and an opening 13*e* having a funnel shape. Recess 13*b* is formed such that the cutting edge 12*a* of the cutter 12 is partially exposed and a thread guiding face 13*a* of member 13 crosses the cutting edge 12*a* at an acute angle ($\theta = 20°$ to 30°). The cover 13*c* shield the cutting edge 12*a*. The groove 13*d* is formed between the cover 13*c* and the thread guiding face 13*a*, and the opening 13*e* is formed at the upper portion of member 13 for guiding the thread.

Figure 3:
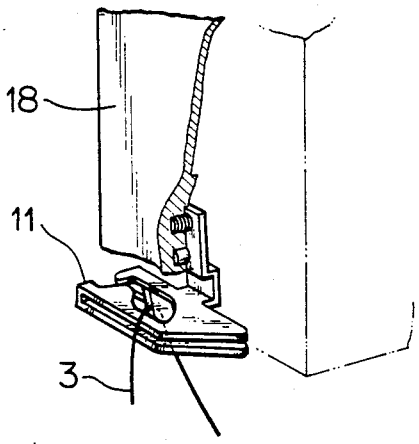
Figure 4:
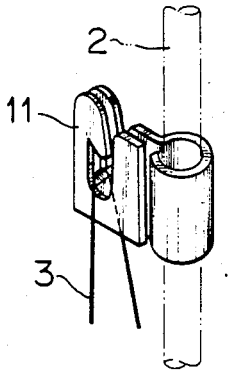
Figure 5:
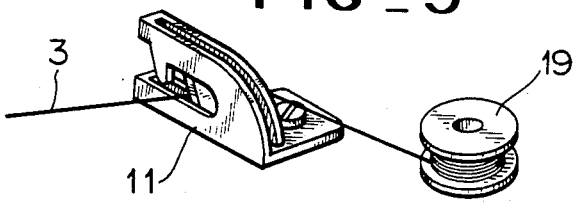
Figure 6:
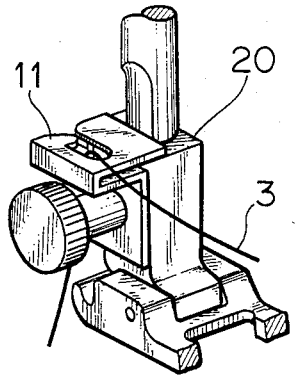
Figure 7:
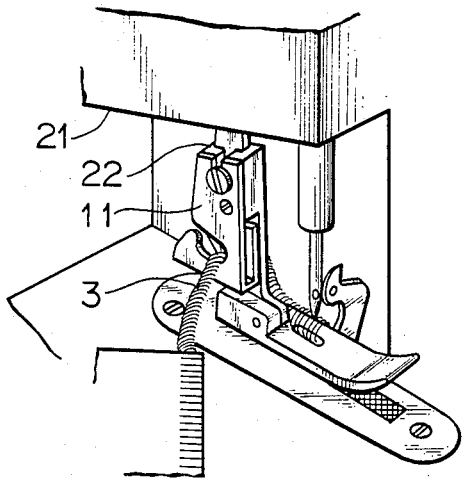

The cutter device 11 is, as shown in FIGS. 3 to 7, adapted to be attached to desired parts of the sewing machine, respectively. That is, the cutter 11 is attached to a face plate 18 as shown in FIG. 3, to a presser bar 2 as shown in FIG. 4, to a thread winding part 19 as shown in FIG. 5, to a presser foot 20 as shown in FIG. 6, and to a presser foot 22 of an overlock sewing machine 21.

Figure 8:
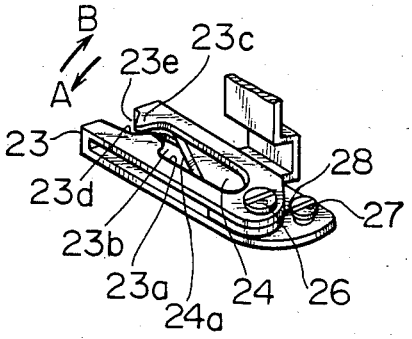
Figure 9:
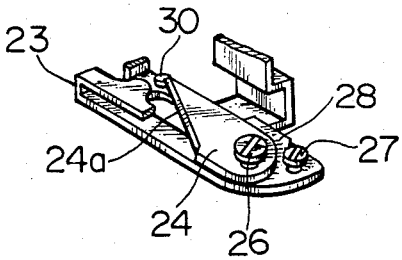

FIGS. 8 and 9 show another embodiment of the invention, in which the crossing point between a thread guiding face 23*a* of the thread guiding member 23 and a cutting edge 24*a* of a cutter may be adjusted. The thread guiding member 23 is of U-shape and is fixed to a base (not shown) via a pivot 26, on which the cutter 24 is mounted in a space formed between the portions of the U-shape thread guiding member 23. The cutter 24 is biased to rotate as shown by arrow A around the pivot 26 by means of a spring 28 secured on the screw 27. The cutter 24 is adjusted in rotation by means of a pin 30 mounted on the thread guiding member 23. Since the functional relationship between the thread guiding face 23*a*, recess 23*b* and cover 23*c*, and also between the grooves 23*d*, the opening 23*e* and the cutting edge 24*a* of the cutter 24 are similar to those of the embodiment shown in FIG. 2, detailed explanation of the function of the device of FIGS. 8 and 9 will be omitted.

Figure 10:
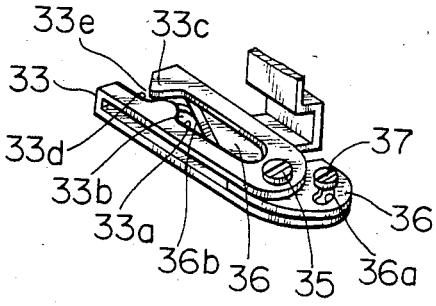
FIG. 10 is a perspective view of a thread cutting means of the other embodiment.

FIG. 10 shows a further embodiment according to the invention, in which a thread guiding member 33 is U-shaped and is fixed to a base (not shown) via a pivot 35, on which a cutter 36 is mounted between the portion of the thread guiding member 33. The cutter 36 is adjustably secured within the thread guiding member 33 by means of a screw 37 within an oblong hole 36*a* formed at one end thereof. Since the functional relationship between the thread guiding face 33*a* of the thread guiding member 33 and the recess 33*b* and the cover 33*c*, and between the groove 33*d*, the opening 33*e* and the cutting edge 36*b* of the cutter 36 are similar to those of embodiment shown in FIG. 2, a detailed explanation of these relations will be omitted.

The present device is structured as described above, and a reference will be made to the function of the thread cutting device shown in FIG. 11. The cutter 40 having a sharp cutting edge 40*a* is secured between the thread guiding members 41 and 42, and the cutting edge 40*a* crosses the thread guiding faces 41*a*, 42*a* of the thread guiding members 41, 42 at an acute angle. while thread 3 is drawn from the thread supply (not shown) a slight thread tension is given to thread 3 by the drawing resistance.

The specific feature of the present invention resides in the structure of the thread cutting device which is safe and may be mounted at any place of the sewing machine, and which has the blade safeguarded and effectively utilized to cut the thread.

Figure 11:
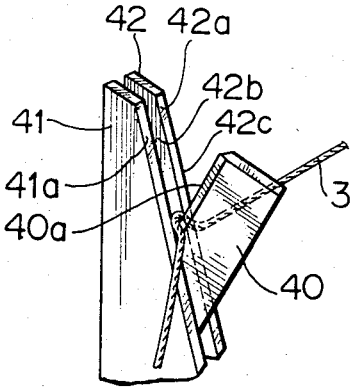
FIG. 11 is a perspective view illustrating the mode of a thread cutting in the thread cutting device according to the invention.

As can seen from FIGS. 2 and 11, if the thread 3 is inserted into the opening 13*e* and moved along the guide path toward the edge 12*a* of the blade 12 as extended across the groove 13*d*, the thread 3 is tensioned between the guide edges 13*a*, 13*a* of the cover plate 13, 14. As the tensioned part of the thread 3 is directly pressed against the edge 12*a* of the blade 12 which intersects the groove 13*d* at a predetermined angle, the thread is easily cut off. Thus the blade 12 is safeguarded and is very effectively utilized to cut off the thread in combination with the thread guide defined by the edges 13*a*, 13*a* of the cover plates 13, 14.

In the embodiment of FIGS. 8 and 9, the blade 24 is turnable on the cover 23 about the pivot 26 and is normally pressed against the pin 30 by the spring 28 which is anchored at one end thereof to the screw 27. Therefore, in case the edge 24*a* of the blade 24 becomes blunt due to a repeated use for thread cutting operations for a long period of time, the blade 24 is turned against the action of the spring 28 by pressure of the tensed thread to provide a new part of the edge 24*a* as the thread is pressed against the edge 24*a*. Thus this edge is extensively and effectively utilized.

In the embodiment of FIG. 10, the blade 36 may be turned about the pivot 35 relative to the cover 33 by loosening the positioning screw 37, to thereby adjust the angular position of the blade 36 with respect to the guide edges 33*a*, 33*a* of the cover 33 when the edge 36*b* is blunt.

In the present device described above, the thread can be cut with a slight tension effected when the thread is pulled from the thread supply. The cutting edge of the cutter is shielded with the cover of the thread guiding member for securing safety of the operator. Further it is possible to adjust the crossing position between the thread guiding face of the thread guiding member and the cutting edge of the cutter.

What is claimed is:

1. A thread cutting device of a sewing machine, comprising a blade having a thread cutting edge; and a blade cover member including two plates spaced from each other to form a space therebetween to accomodate said blade, said cover member having an end side and being formed with a thread-guiding opening at said end side and with a recess, said opening merging into said recess, said recess defining on said plates two parallel guide edges spaced from each other, said blade being positioned between said plates so that said cutting edge intersects said guide edges at a predetermined acute angle, whereby as the thread is moved through said opening and said recess towards the cutting edge of said blade and is received in said space so that said guide edges and said cutting edge impart tension to the threead received in said space while the thread is pressed against said guide edges.

2. The device as defined in claim 1, wherein said blade is movable relative to said cover member such that an angle of intersection between said guide edges and said cutting edge is adjusted.

3. The device as defined in claim 1, wherein said cover member substantially shields said cutting edge of said blade.

4. The device as defined in claim 1, wherein said blade is pivotable relative to said cover member such that an angle of intersection of said cutting edge relative to said guide edges is adjusted.

5. The device as defined in claim 4, further including a pin mounted on said cover member for limiting the pivoting movement of said blade.

6. The device as defined in claim 5, further including spring means normally biasing said blade against said pin.

7. The device as defined in claim 6, wherein said opening is funnel-shaped for guiding thread to be cut towards said recess.

8. The device as defined in claim 1, wherein said blade is rigidly connected to said cover member.

9. The device as defined in claim 1, wherein said sewing machine has a face plate, the device further comprising means for securing said device to said face plate.

10. The device as defined in claim 1, wherein said sewing machine has a fabric presser bar, the device further comprising means for securing said device to said fabric presser bar.

11. A thread cutting device of a sewing machine, comprising a blade having a thread cutting edge; and a blade cover member including two plates spaced from each other to accomodate said blade therebetween, said cover member having an end side and being formed with a thread-guiding opening at said end side and with a recess, said opening merging into said recess, said recess defining on said plates two parallel guide edges spaced from each other, said blade being adjustably positioned between said plates so that said cutting edges can be set to intersect said guide edges at predetermined acute angles, whereby, as the thread is moved through said opening and said recess towards the cutting edge of said blade and is received in a space between said plates, said guide edges and said cutting edge impart tension to the thread received in said space while the thread is pressed against said guide edges.

* * * * *